US005988441A

United States Patent [19]

Weinaug et al.

[11] Patent Number: 5,988,441

[45] Date of Patent: Nov. 23, 1999

[54] FLUID MERCHANDISER FOR BEVERAGE DISPENSER

[75] Inventors: Kenneth S. Weinaug, Lilburn; John J. Fisher, Alpharetta; Roger C. Whigham; Steven C. Gamper, both of Atlanta; Alvin C. Mayshack; Bruce W. Copeland, both of Stone Mountain; D. Scott Rowley, Smyrna; Augusto S. Medina, Atlanta, all of Ga.

[73] Assignee: The Coca-Cola Company, Atlanta, Ga.

[21] Appl. No.: 08/729,610

[22] Filed: Oct. 11, 1996

Related U.S. Application Data

[63] Continuation-in-part of application No. 08/495,126, Jun. 27, 1995, abandoned.

[51] Int. Cl.[6] ..... B67D 5/56

[52] U.S. Cl. ..... 222/78; 222/129.1; 222/131; 239/23

[58] Field of Search ..... 222/78, 129.1, 222/146.6, 154, 159, 130, 139, 318, 131; 239/23; 40/406, 407

[56] References Cited

U.S. PATENT DOCUMENTS

| | | | |
|---|---|---|---|
| 1,124,905 | 1/1915 | Huber . | |
| 1,487,816 | 3/1924 | Sintzel . | |
| 1,654,379 | 12/1927 | Matzka . | |
| 1,669,444 | 5/1928 | Borchert . | |
| 1,760,887 | 6/1930 | Saugman . | |
| 1,762,126 | 6/1930 | Smith . | |
| 1,782,685 | 11/1930 | Glaze et al. . | |
| 1,782,943 | 11/1930 | Stanford et al. . | |
| 1,782,944 | 11/1930 | Stanford et al. . | |
| 2,072,841 | 3/1937 | Tracey et al. . | |
| 2,203,054 | 6/1940 | Holmes . | |
| 2,356,784 | 8/1944 | Graham . | |
| 2,505,369 | 4/1950 | Stewart . | |
| 2,675,145 | 4/1954 | Jacobs | 239/23 |
| 2,741,400 | 4/1956 | Hazzard . | |
| 2,924,033 | 2/1960 | Lanctot . | |
| 3,205,610 | 9/1965 | Palumbo et al. . | |
| 3,206,069 | 9/1965 | Jacobs et al. . | |
| 3,225,965 | 12/1965 | Jacobs et al. | 222/129.1 |
| 3,253,354 | 5/1966 | Gollner et al. . | |
| 3,321,081 | 5/1967 | Willinger . | |
| 3,341,077 | 9/1967 | Gordon | 222/129.1 |
| 3,420,184 | 1/1969 | Englesberg et al. . | |
| 3,503,541 | 3/1970 | Jacobs et al. . | |
| 3,531,635 | 9/1970 | Hancock . | |
| 4,160,512 | 7/1979 | Cleland . | |
| 4,366,920 | 1/1983 | Greenfield, Jr. et al. . | |
| 4,408,891 | 10/1983 | Schirk et al. . | |
| 4,419,283 | 12/1983 | Schneider . | |
| 4,490,931 | 1/1985 | Fleemin . | |
| 4,538,636 | 9/1985 | Cleland . | |
| 4,544,084 | 10/1985 | Cleland . | |
| 4,631,210 | 12/1986 | McGee et al. . | |
| 4,676,401 | 6/1987 | Fox et al. . | |
| 4,686,784 | 8/1987 | Smithies . | |
| 4,728,005 | 3/1988 | Jacobs et al. . | |
| 4,781,310 | 11/1988 | Credle, Jr. et al. . | |
| 4,856,676 | 8/1989 | Embody . | |
| 5,135,738 | 8/1992 | Gaffar et al. | 222/107 |
| 5,258,209 | 11/1993 | Bankert et al. . | |

FOREIGN PATENT DOCUMENTS

| | | |
|---|---|---|
| 0133645 | 3/1947 | Austria . |
| 0598809 | 5/1925 | France . |
| 1004627 | 12/1949 | France . |
| 0017552 | of 1906 | United Kingdom . |
| 206156 | 10/1923 | United Kingdom . |
| 0423155 | 12/1925 | United Kingdom . |

*Primary Examiner*—Philippe Dergkshani
*Attorney, Agent, or Firm*—Dennis W. Braswell

[57] ABSTRACT

A sealed fluid merchandiser (12) for use in connection with a beverage dispenser (16) includes a transparent, liquid display container (60) having a narrow liquid chamber (33) for a stable liquid (21) that simulates the beverage being dispensed and a pump housing (37) for a pump (38) that pumps the liquid being simulated through a spray manifold (44) for producing an attractive spray or bubbling effect. The stable, simulated beverage liquid has a low viscosity such that it behaves substantially identical to the beverage being dispensed. The narrow liquid chamber substantially reduces the weight and expense of the fluid merchandiser.

26 Claims, 6 Drawing Sheets

FLUID MERCHANDISER FOR BEVERAGE DISPENSER

CROSS-REFERENCE TO RELATED APPLICATION

This is a continuation-in-part to U.S. patent application Ser. No. 08/495,126 filed Jun. 27, 1995 with the same title, inventors and assignee as the present application now abandoned.

TECHNICAL FIELD OF THE INVENTION

This invention relates generally to beverage dispensers, and more particularly to fluid merchandisers (or "bubblers") for beverage dispensers.

BACKGROUND OF THE INVENTION

A wide variety of beverage dispensers are presently available, including fountain dispensers, vending machines, and glass door merchandisers, among other types of beverage dispensers. Of these dispensers, the fountain type has become very popular, and is found in a wide variety of settings, including restaurants, convenience stores, and sports arenas, among many others. Fountain type dispensers are used to dispense both premix and postmix beverages, such as soft drinks and fruit juices.

To better merchandise the beverages that are dispensed from fountain dispensers, fluid merchandisers, known as "bubbler" devices, have been developed for use in conjunction with such dispensers. Typically, a bubbler device is placed on top of a fountain dispenser, and is generally in the form of one or more transparent bowls. The beverage being dispensed, or a liquid colored to appear to consumers to be the beverage being dispensed, is sprayed or bubbled within the clear bowl to give the appearance that the beverage to be dispensed is being drawn from the bowl, and is particularly fresh. The beverage dispenser and fluid merchandiser are collectively referred to as a beverage merchandiser.

Several problems have arisen with bubblers that make use of colored fluids to simulate the beverage being dispensed. For example, when such fluids are used, the possibility for the growth of microbiological organisms, such as bacteria, mold and algae, or other unsightly growths, can arise. To avoid these growths, stable fluids, that is, fluids which are resistant to organic growth, are used. However, the viscosity of such fluids is higher than that of the beverage being simulated, and therefore bubbling does not appear natural. Although the addition of water to such prior art (resulting because the prior art bowls are not hermetically sealed) fluids can reduce viscosity, this also causes unsightly precipitate to form in the bowl, and evaporation of the water results in the need for additional maintenance to maintain the proper viscosity level.

Another problem with prior art bubblers involves their general size and shape. Prior art bowls include a relatively large volume of liquid, making them heavy, unwieldy and relatively difficult to install, service, and replace. Furthermore, pumps used to bubble the fluid are not well shielded by existing bubblers, and are often somewhat visible to the consumer, thus reducing the overall appeal of the bubbler. Or, shields that are used are often conspicuous in and of themselves, such as those made of white plastic.

Many fountain dispensers are designed to dispense at least two different beverages. It is therefore desirable to include two bubblers, one for each beverage being dispensed. With some existing simulated bubbler designs, a specific bubbler is required for each of the two sides of the fountain. Therefore, such bubblers are not interchangeable. This lack of interchangeability presents inventory and flexibility problems.

Therefore, a need has arisen for an improved beverage merchandiser that substantially reduces or eliminates these and other problems associated with prior art bubblers.

SUMMARY OF THE INVENTION

A beverage merchandiser comprising a fluid merchandiser and a beverage dispenser is provided having significant advantages over the prior art. In particular, the beverage merchandiser of this invention includes a hermetically sealed, transparent, liquid display container including an outer wall and an inner immediately behind the outer wall with a narrow liquid chamber therebetween filled with a stable liquid simulating a beverage and having a viscosity around 3–4 such that the liquid behaves substantially the same as that of the beverage. The container includes a pump housing, a submersible pump therein and a manifold through which the pump sprays or bubbles the simulated beverage. The narrow chamber reduces the weight and expense of the fluid merchandiser. The fluid merchandiser preferably includes a bowl and a lid hermetically sealed to the bowl lid. When two fluid merchandisers are used on one dispenser, they are identical and interchangeable. The container is plastic with UV inhibitors therein.

In a preferred embodiment, the liquid comprises propylene glycol in the range of from about 35% to 45% by weight and water in the range of from about 65% to 55% by weight. In the most preferred embodiment, the propylene glycol is present in the amount of 36.3% by weight.

Several important technical advantages result from the present invention. In particular, the lid and bowl member of the fluid merchandisers of the present invention are hermetically sealed coupled, thereby preventing evaporation of the fluid. Because evaporation of the fluid contained within the fluid merchandiser of the present invention is significantly reduced over prior art systems, a stable fluid can be used that has a viscosity close to that of the actual beverages being dispensed. Prior art stable fluids were not contained in a sealed bowl and have a much higher viscosity which requires a larger and more expensive pump and increases the heat impact to the system.

Another important technical advantage of the present invention is the fact that ultra-violet light inhibitors are included in the plastic that forms the fluid merchandiser, thereby preventing discoloration of both the plastic fluid merchandiser and the fluid contained within the fluid merchandiser.

BRIEF DESCRIPTION OF THE DRAWINGS

For a more complete understanding of the present invention and the advantages thereof, references now made to the following description taken in conjunction with the accompanying drawings in which like reference numbers indicate like features and wherein.

DETAILED DESCRIPTION OF THE INVENTION

Figure 1:
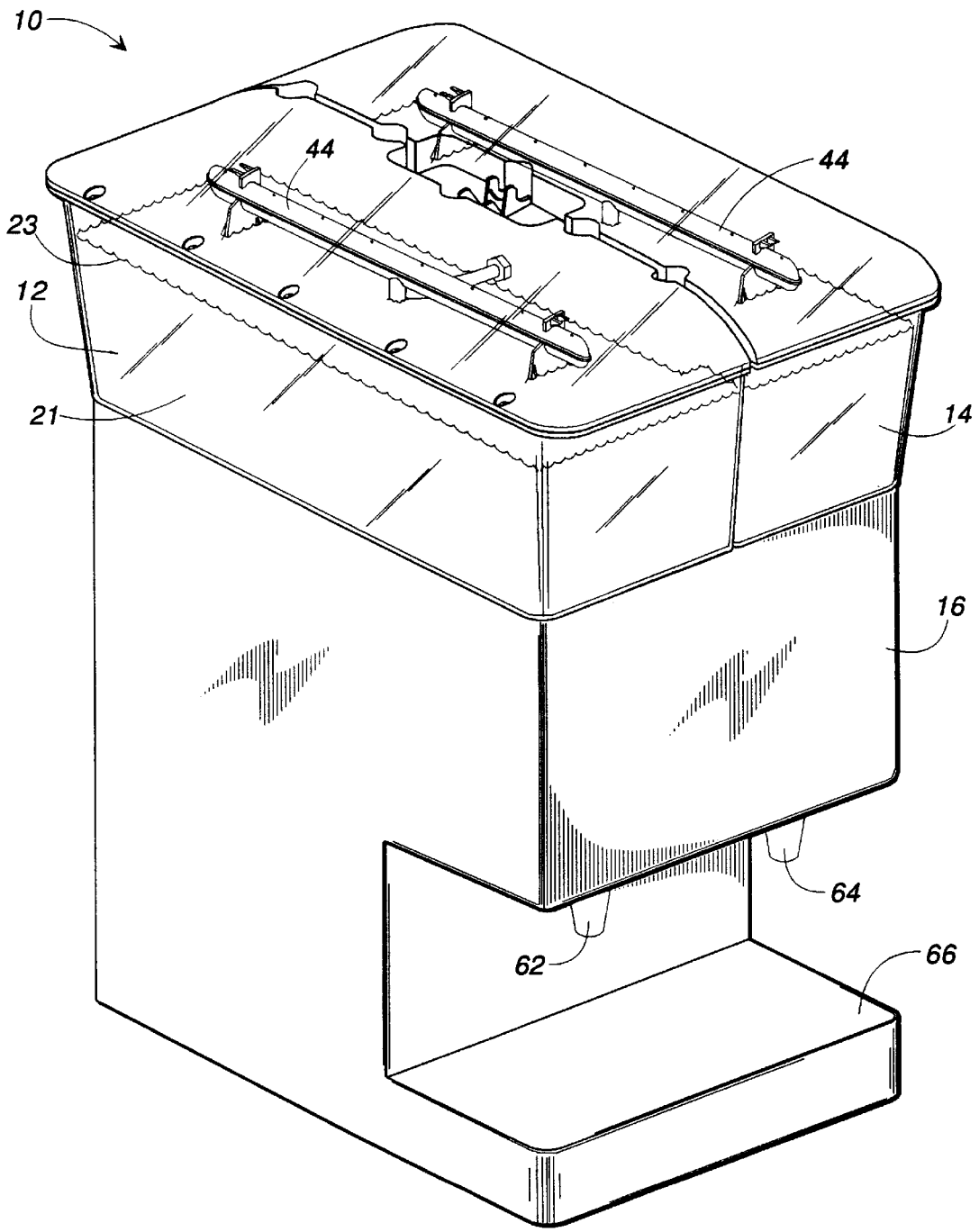
FIG. 1 is a perspective view of a beverage merchandiser according to the present invention.

FIG. 1 is a perspective view of the preferred beverage merchandiser 10 according to the present invention. The beverage merchandiser 10 includes two liquid merchandisers ("bubblers") 12 and 14, and a beverage dispenser 16. Each of the bubblers 12 and 14 are hermetically sealed, and include a manifold 44 and a liquid 21 to a level 23 that simulates the appearance of one of the beverages actually being dispensed by the beverage dispenser 16. The beverage dispenser 16 may be most any type of fountain dispenser, and in particular may dispense postmix or premix beverages. The dispenser 16 includes two beverage dispensing nozzles 62 and 64 for dispensing beverages into cups (not shown) held beneath the nozzles and on or above the drip tray 66. The bubblers 12 and 14 contain liquids that simulate or give the appearance of being the actual beverages dispensed, but there is no liquid connection between the liquid in the bubblers and the nozzles 62 and 64.

The bubblers 12 and 14 are substantially transparent, so as to allow consumers to view the liquids contained within the bubblers 12 and 14. As will be discussed in detail below, pumps are used to spray or bubble fluid within the bubblers 12 and 14, to produce an eye-catching and appealing fountain-type display and to enhance the impression that the beverages being dispensed by beverage dispenser 16 are supplied from bubblers 12 and 14. The use of the term "bubble" within this description includes any circulation of the fluid within the bubblers, such as that created by bubbling air or other gases through the fluid, spraying the fluid upward so as to create a fountain or cause a sheeting effect within the bubblers, or any other type of circulation.

Because the two fluid merchandisers 12 and 14 of the present invention are identical and interchangeable, a description of just one of the fluid merchandisers will be provided.

Figure 2:
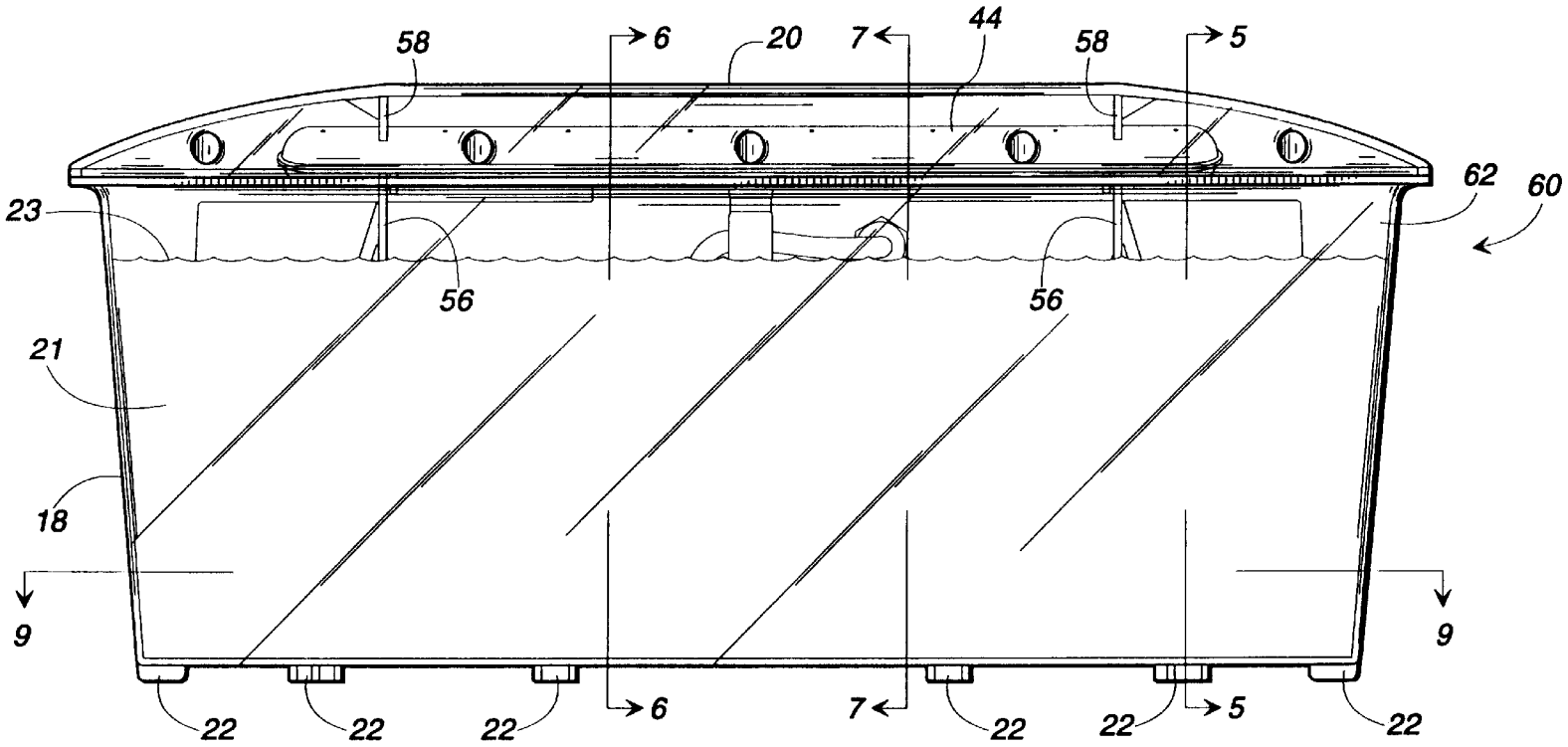
FIG. 2 is an outside side view of the fluid merchandiser of the present invention.

FIG. 2 shows the fluid merchandiser 12 including a transparent, liquid display container 60 that includes a visually prominent outer wall 62 and a hidden inner wall 64 (see FIG. 5) immediately inside of the outer wall, and integral with the outer wall. A narrow liquid chamber 33 (see FIG. 5) is located between the outer and inner walls. The narrow chamber 33 is preferably about one inch wide at the top and one-half inch wide at the bottom. The simulated beverage liquid 21 fills the chamber 33; the liquid level 23 is actually about one-half inch above the top of the narrow chamber. Sufficient volume of the liquid has to be present to prevent the pump from being starved. The container 60 is substantially empty or hollow inside of the inner wall 64, except for the pump housing 37. The container 60, however, gives the appearance from the outside of being substantially full of the liquid 21 while in fact it is substantially hollow and much lighter in weight than if it were actually full of the liquid.

The container 60 includes a bowl 18 and a lid 20 hermetically sealed together to prevent evaporation of the liquid 21 from the bowl 18. The bowl and lid are screwed together by screws 19 (FIG. 3) with a silicone o-ring 31 (FIG. 6A) therebetween. The bowl 18 includes locating tabs 22 extending downwardly from the lower surface of the bowl which engage in matching receiving grooves (not shown) in the beverage dispenser 16 to locate the bubbler in the desired position on the dispenser. In the preferred embodiment, about 1.1 gallons of fluid are used in the bowl, in contrast to the prior art bowl which uses about 2.5 gallons of fluid. This significantly reduces the total weight of the fluid merchandiser (by about 10 pounds).

The bowl 18 and lid 20 can alternatively be integrally formed or permanently fastened, such as by bonding, without departing from the intended scope of the present invention. Also, the outer wall 62 can be one member (e.g. both the bowl and the lid) and the inner wall a separate, second member sealed to the outer wall.

Figure 3:
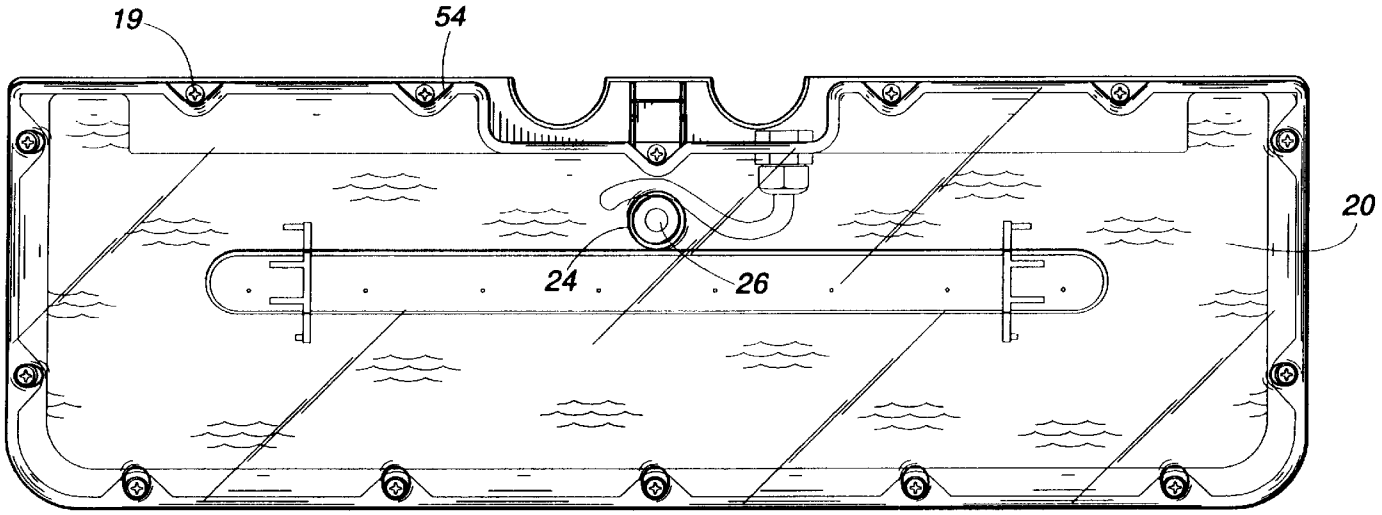
FIG. 3 is a top view of the fluid merchandiser of FIG. 2.

FIG. 3 is a top view of lid 20, showing a liquid fill hole 24 for filling the bowl 18 with the liquid 21. Hole 24 is sealed with a plug 26 solvent bonded to the lid 20. It should be understood, however, that the hole 24 and plug 26 need not be provided, because the bowl can alternatively be filled before putting the lid on. Grooves 54 in the lid provide access to the screws 19.

Figure 4:
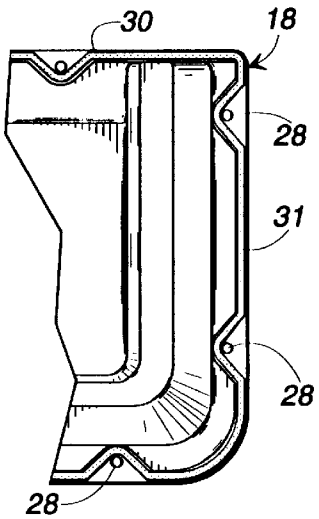
FIG. 4 is a partial top view of the bowl of the fluid merchandiser of FIG. 4.

FIG. 4 is a partial top view of the bowl 18 (with the lid 20 removed). A plurality of holes 28 are provided in the bowl sidewall for receiving screws 19 to connect the lid 20 to the bowl 18. Also shown in FIG. 4 is slot or groove 30 for receiving the gasket or O-ring 31. In a preferred embodiment, the slot 30 is sized to accommodate a 0.07 inch diameter O-ring made of silicone.

An important technical advantage of the present invention is the fact that the bubblers 12 and 14 are identical and symmetrical, and therefore may be placed on either side of the beverage dispenser 16. Because they are interchangeable, inventory can be reduced, and replacement is made more efficient.

Figure 5:
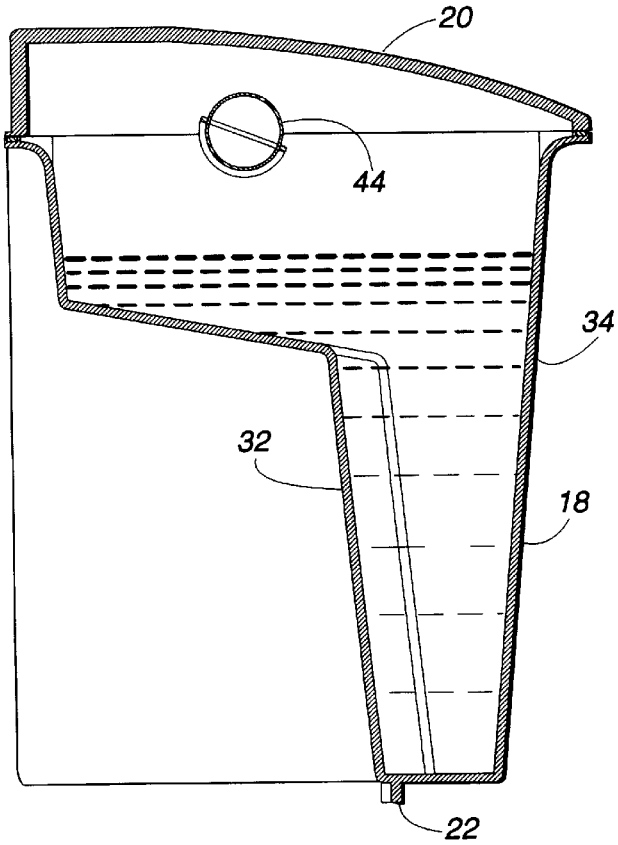
FIG. 5 is a cross-sectional end view of the fluid merchandiser taken along line 5—5 of FIG. 2.

FIG. 5 shows the shape of the bowl 18 that allows the amount of liquid 21 contained within the bowl to be significantly reduced, while still providing the outside appearance to consumers of a "full-sized" bowl. The shape of the bowl 18 that provides this advantage is the use of an outer wall 34 (forming the front, side and back outer walls of the bowl) and an inner wall 32 spaced apart only a short distance from the outer wall 34 to provide the narrow liquid chamber 33 visible from the outside (front, back and side) of the bowl 18 and giving the appearance that the entire inside volume of the bowl 18 is filled with liquid. Thus, the bowl 18 is basically hollow except for the thin or narrow liquid chamber 33 around the outside periphery thereof and except for a pump housing described below. This periphery includes the front, back and side, but if the bowl were a single bowl on the dispenser, then the liquid chamber would be on all four sides thereof. That is, it need only be on the exposed sides of the bowl, whatever that number of sides is, whether one, two, three or four.

Figure 6:
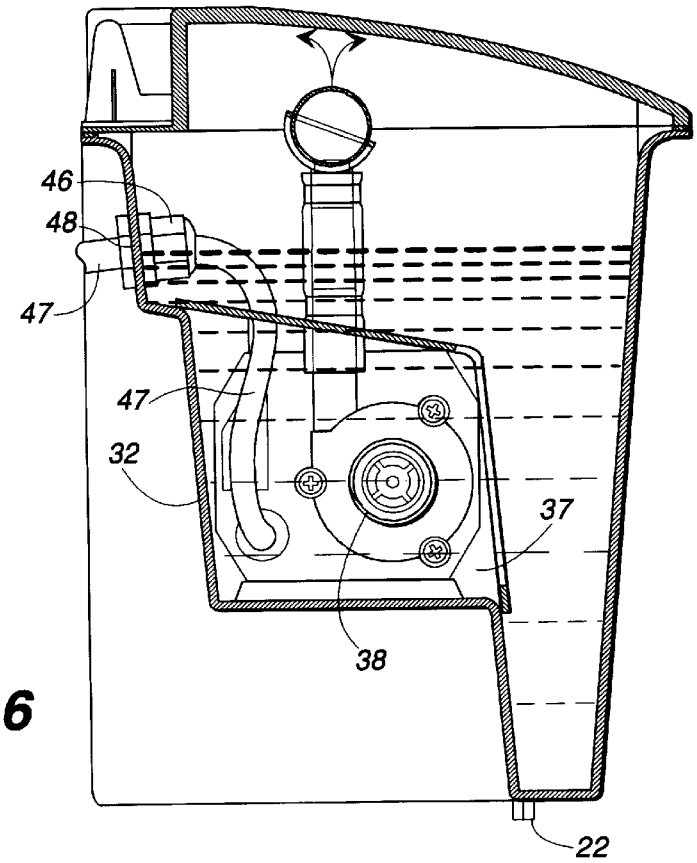
FIG. 6 is a cross-sectional end view taken along line 6—6 of FIG. 2.
Figure 6A:
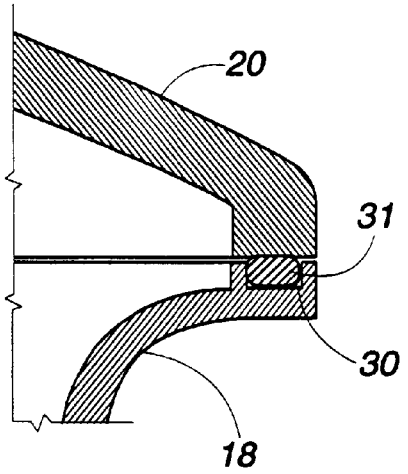
FIG. 6A is an enlarged cross-sectional view through the gasket of FIG. 6.
Figure 7:
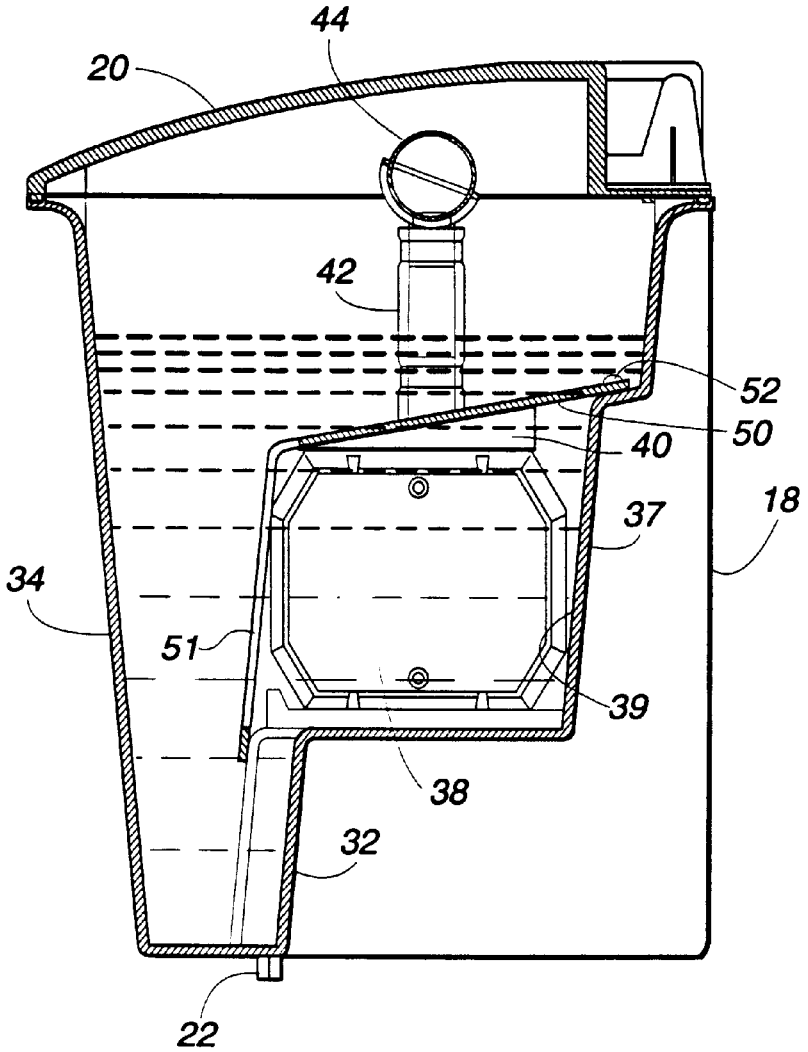
FIG. 7 is a cross-sectional end view taken along line 7—7 of FIG. 2.
Figure 8:
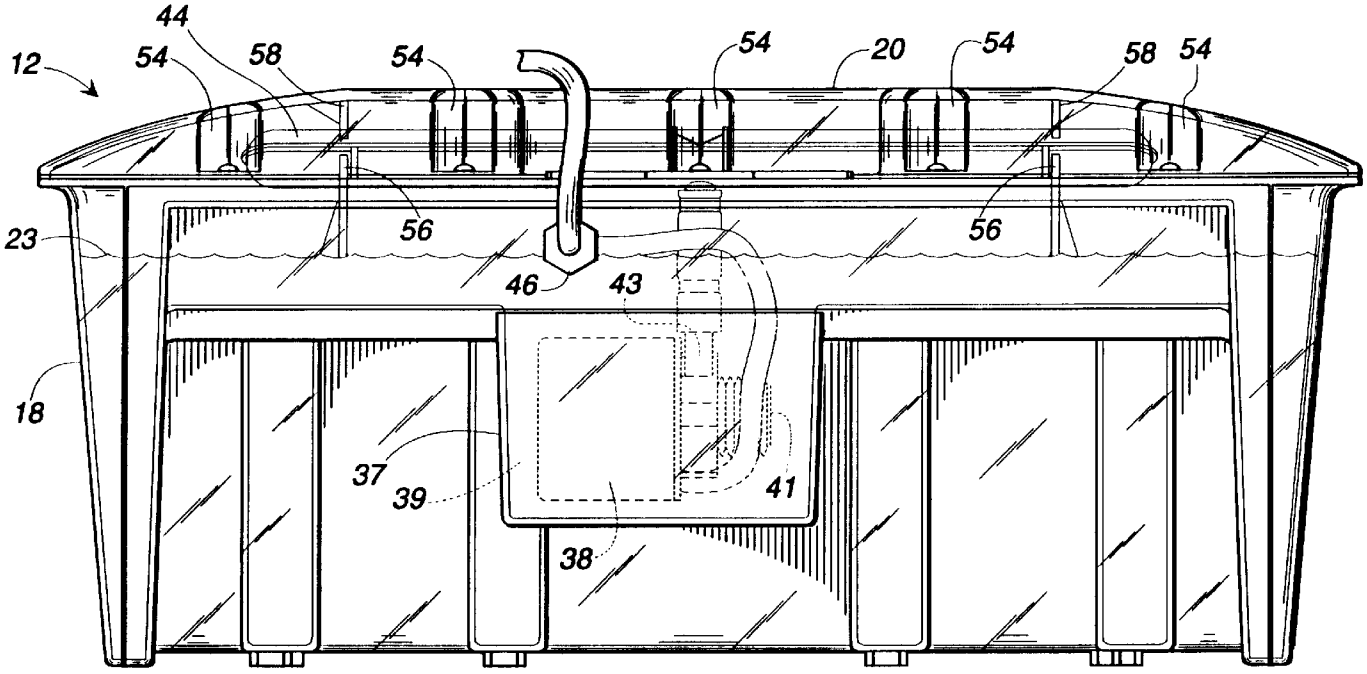
FIG. 8 is an inside side view of the fluid merchandiser of FIG. 2.

FIGS. 6, 7 and 8 show the inner wall 32 shaped to provide a pump housing 37 enclosing a pump chamber 39. The housing 33 is located in the hollow interior of the bowl 18. A submersible pump 38 is secured in the pump chamber 39 by a plastic shroud 50. The pump has an inlet 41 and an outlet 43 (FIG. 8).

The pump 38 can be a model G210AG, marketed by the Beckett Company, and rated at 115 VAC, 0.5 A. However, it should be understood that any suitable submersible pump may be used without departing from the intended scope of the present invention. Furthermore, non-submersible pumps may also be used, with such pumps disposed outside of the bowl 18. With such non-submersible pumps, fluid is routed, for example through conduits, to and from the pump for the necessary circulation. Alternatively, a submersible impeller can be magnetically or inductively coupled to a pump motor located outside of the bowl 18.

The plastic shroud 50 is provided to help hide the pump from the view of consumers and also to hold the pump in place. Shroud 50 is disposed over pump 38 and is secured with fasteners 52, and includes slots 51 to allow liquid to flow to the pump inlet 41. The tool for the shroud is preferably not polished so as to yield a somewhat opaque plastic. The entire back surface of the bowl including the pump housing is textured so that one can not see through it.

The outlet flow of fluid from the impeller of pump 38 is coupled through a conduit 42 to an elongated manifold 44. Manifold 44 is used to divert the outlet flow from the pump 38. The manifold can be provided with outlets of various sizes and shapes for different spray and/or bubbling effects. In a preferred embodiment, as will be discussed below, the manifold 44 includes openings 45 that create a spray of fluid onto the inside of surface of lid 20, thus presenting a pleasing and appealing sheeting effect to the consumer.

FIG. 6 shows a liquid tight fitting 46 for providing electrical access via wire 47 from outside the bowl 18 to the pump 38. Liquid tight fitting 46 fits through a hole 48 formed through the inner wall 32 of the bowl.

The bowl 18 and lid 20 can be formed of any suitable plastic, and in a preferred embodiment are formed from a clear plastic copolyester, Eastman Chemical resin DN102, although others such as PETG can be used. Furthermore, the plastic used to form the bowl 18 and lid 20 preferably have ultraviolet inhibitors included in the resin (any known UV inhibitor can be used). These inhibitors will reduce discoloration of the plastic and will protect the fluid 21 contained within the bubbler from discoloring due to ultraviolet light exposure.

Figure 9:
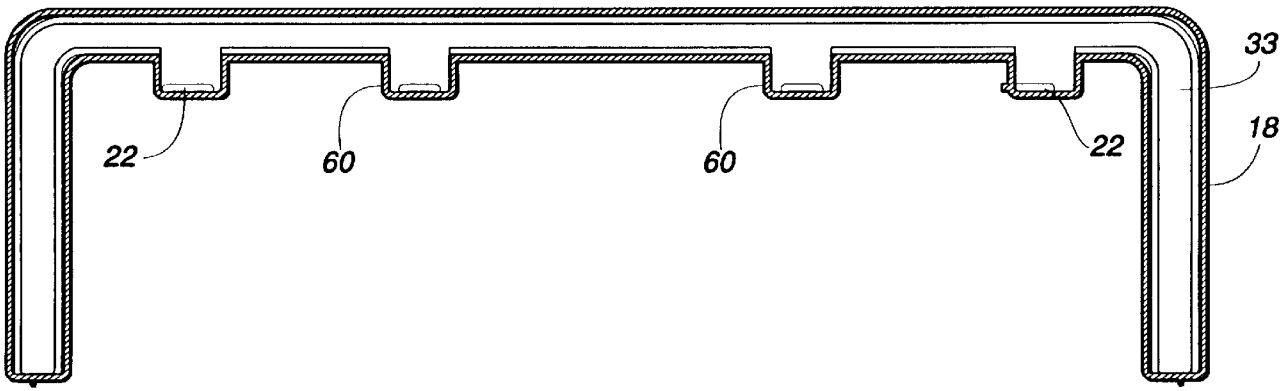
FIG. 9 is a cross-sectional top view taken along line 9—9 of FIG. 2.

FIG. 9 shows the thin or narrow chamber 33 that allows for a greatly reduced volume (and therefore, expense) and weight of fluid that is contained therein. Ribs 60 are provided to support the locating tabs 22.

Figure 10:
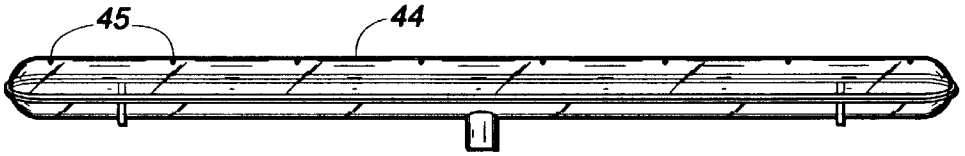
FIG. 10 is a side view of the manifold.

FIG. 10 shows a preferred embodiment of the manifold 44. It should be understood, however, that other manifolds can be used without departing from the intended scope of the invention. In the particular embodiment shown in FIG. 10, the manifold is cylindrical with a plurality of holes 45 located along its length and sides, so as to result in a sheeting action of fluid along the inside surface of lid 20.

Because the fluid merchandiser disclosed herein is sealed, the fluid used to simulate the beverage being dispensed can be formulated to have a viscosity lower than that of prior art fluids, and thus to more closely resemble that of the beverages being dispensed. Furthermore, it is preferable to provide a fluid that has a freezing point of about 0° F., to facilitate transportation. Also, it is preferable that the fluid be food-grade (non-toxic), to avoid any likelihood of injury caused by inadvertent drinking. In particular, a fluid with substantially the following characteristics is extremely stable and has a low viscosity such that it behaves nearly identically to the beverages being dispensed.

| | |
|---|---|
| Propylene Glycol | from about 35% to 45% (by weight) |
| Citric Acid | from about 0.05 to 0.1% (by weight) |
| Sodium Benzoate | from about 0.02 to 0.1% (by weight) |
| Potassium Sorbate | from about 0.02 to 0.1% (by weight) |

The propylene glycol is both a preservative and lowers the freezing point of the liquid. The citric acid lowers the pH to about 4–5 where the sodium benzoate and potassium sorbate are more effective. The sodium benzoate and potassium sorbate are preservatives to assist in prevention of the growth of mold, yeast, other microbiological organisms (such as bacteria), and other impurities. These preservatives may be omitted without departing from the present invention. Colorings are added to these fluid formulations to simulate beverages being dispensed. As discussed above, it is preferable that the fluid be food-grade, and thus any such colorings are preferably food-grade colorings. Furthermore, an emulsion can be added to cloud the fluid, to simulate cloudy beverages. The remaining volume of these formulations are made up with water. As stated above, because the bubbler of the present invention is sealed, there will be no substantial water evaporation, thus providing a significant technical advantage of over prior art bubblers. Furthermore, the fluid can include and ultra-violet light inhibitor.

All of the components listed above are water soluble, thus avoiding unsightly precipitates. The sodium benzoate and potassium sorbate should first be dissolved in the aqueous propylene glycol solution, and the citric acid added to the clear solution. Alteration of the sequence can lead to formation of benzoic acid and sorbic acid crystals, although such crystals will dissolve after sufficient agitation of the solution. Citric acid levels greater than that discussed above can be used. However, for long term use with emulsions, the increased acid level will degrade the emulsion, resulting in an unsightly ring.

In summary, a beverage merchandiser is provided which offers significant advantages over prior art systems. In particular, because of the narrow chamber 33 the cost of the liquid is reduced and the weight is reduced. In addition, the stable fluid of this invention has a viscosity of below 5 and in a preferred embodiment has a viscosity of from about 2.7 at 120° F. to 3.9 at 70° F., at which viscosity it looks and acts in the bubbling action substantially identical to the actual beverages being dispensed. This is in sharp contrast to the commercially available simulated bubbler in which the liquid in the bubbler has a viscosity of about 50 and does not look remotely as close to the actual beverages being dispensed. Furthermore, the pump used for fluid circulation is shrouded by a translucent plastic shroud, thereby reducing the visibility of the pump.

An exemplary beverage dispenser 16 is the ICI TM20R base dispensing unit. It should be understood, however, that the shape of the bubblers 12 and 14 may be adjusted to accommodate any base dispensing unit without departing from the intended scope of the present invention.

Although the present invention has been described in detail, it should be understood that various changes, alterations, modifications, additions, and substitutions can be made without departing from the intended scope of the present invention as defined by the appended claims.

What is claimed is:

1. A beverage merchandiser, comprising:

a beverage dispenser; and a fluid merchandiser disposed adjacent said beverage dispenser, said fluid merchandiser including:

a lid;

a bowl hermetically scaled to said lid, said bowl including a pump housing and a shroud disposed adjacent at least a portion of said housing;

a pump disposed within said housing, such that said shroud reduces visibility of said pump; and a liquid separate from the beverage being dispensed.

2. The beverage merchandiser as recited in claim 1 wherein said beverage merchandiser includes two of said fluid merchandisers adjacent said dispenser.

3. The beverage merchandiser as recited in claim 2 wherein said fluid merchandisers are identical and interchangeable.

4. The beverage merchandiser as recited in claim 1 wherein said lid and bowl are made of plastic and include an ultra-violet light inhibitor.

5. The beverage merchandiser as recited in claim 1 further comprising an O-ring disposed between said lid and bowl.

6. The beverage merchandiser as recited in claim 1 wherein said pump includes an inlet and an outlet and further comprising a manifold with outlet spray holes coupled to said pump outlet for splaring the liquid in said bowl onto an inside surface of said lid.

7. The beverage merchandiser as recited in claim 1, said liquid comprising:

between about 35% and 45% propylene glycol by weight; and between about 65% and 55% water by weight.

8. The beverage merchandiser as recited in claim 7 wherein said liquid also includes:

citric acid in the range of from about 0.05% to 0.1% by weight;

sodium benzoate in the range of from about 0.02% to 0.1% by weight; and potassium sorbate in the range of from about 0.02% to 0.1% by weight.

9. The beverage merchandiser as recited in claim 1 wherein said shroud is translucent.

10. A beverage merchandiser comprising:

a beverage dispenser;

a fluid merchandiser disposed adjacent said dispenser and including a lid and a bowl hermetically sealed to said lid; and a pump operable to pump a liquid located within said bowl, said liquid comprising:

propylene glycol in the range of from about 35% to 45% by weight; and water in the range of from about 65% to 55% by weight.

11. The beverage merchandiser as recited in claim 10 said liquid further comprising:

citric acid in the range of from about 0.05% to 0.1% by weight;

sodium benzoate in the range of from about 0.02% to 0.1% by weight; and potassium sorbate in the range of from about 0.02% to 0.1% by weight.

12. The beverage merchandiser as recited in claim 11 wherein said beverage merchandiser includes two of said fluid merchandisers adjacent said dispenser.

13. The beverage merchandiser as recited in claim 12 wherein said fluid merchandisers are identical and interchangeable.

14. The beverage merchandiser as recited in claim 10 wherein said lid and bowl are made of plastic and include an ultra-violet light inhibitor.

15. The beverage merchandiser as recited in claim 10 further comprising an O-ring disposed between said lid and bowl.

16. The beverage merchandiser as recited in claim 10 wherein said pump includes an inlet and an outlet and further comprising a manifold with outlet spray holes coupled to said pump outlet for spraying a liquid in said bowl onto an inside surface of said lid.

17. The beverage merchandiser as recited in claim 10 wherein said liquid further comprises an ultra-violet light inhibitor.

18. The beverage merchandiser as recited in claim 10 wherein said pump is disposed within said bowl.

19. A beverage merchandiser comprising:

a beverage dispenser;

a first fluid merchandiser including a transparent, liquid display container in contact with said dispenser in a visually prominent location for attracting attention;

a second fluid merchandiser including a transparent, liquid display container in contact with said dispenser in a visually prominent location for attracting attention, said second fluid merchandiser being separate from said first fluid merchandiser; and said first and second fluid merchandisers being identical to each other and being interchangeable with each other on said dispenser, and using a liquid that is separate from the beverage being dispensed.

20. The apparatus as recited in claim 19 wherein each of said containers includes an exposed outer wall and a hidden, integral inner wall and including a narrow liquid chamber behind said outer wall and contained between said outer wall and said inner wall.

21. The apparatus as recited in claim 20 wherein each of said containers is hollow inside of said inner wall except for a pump housing, and including a submersible, recirculating pump located in said pump housing.

22. The apparatus as recited in claim 21 wherein said container includes a bowl and a lid sealed to said bowl, and a fountain manifold located within said container and connected to said pump, and extending substantially the length of said container.

23. The apparatus as recited in claim 22 including a shroud covering said pump to reduce its visibility.

24. The apparatus as recited in claim 23 wherein said container is made of plastic and said plastic includes a U.V. inhibitor.

25. The apparatus as recited in claim 19 wherein said liquid has a viscosity of about 4.

26. A simulated beverage liquid for use in a bubbler comprising:

(a) propylene glycol in the range of from about 35% to 45% by weight;

(b) water in the range of from about 65% to 55% by weight;

(c) citric acid in the range of from about 0.05% to 0.1% by weight;

(d) sodium benzoate in the range of from about 0.02% to 0.1% by weight; and (e) potassium sorbate in the range of from about 0.02% to 0.1% by weight.

* * * * *